US005649587A

United States Patent [19]

Plant

[11] Patent Number: 5,649,587

[45] Date of Patent: Jul. 22, 1997

[54] FAN SHROUD AND RECEPTACLE ARRANGEMENT

[75] Inventor: William David Plant, Anderson, S.C.

[73] Assignee: McCord Winn Textron, Inc., Manchester, N.H.

[21] Appl. No.: 605,981

[22] Filed: Feb. 23, 1996

[51] Int. Cl.[6] ..... F01P 9/04; F01P 7/10

[52] U.S. Cl. ..... 165/41; 165/122; 123/41.49; 180/68.1

[58] Field of Search ..... 165/121, 122, 165/41, 104.32; 123/41.57, 41.49, 41.51; 180/68.1

[56] References Cited

U.S. PATENT DOCUMENTS

| | | | |
|---|---|---|---|
| 3,692,004 | 9/1972 | Tangue et al. | 123/41.57 |
| 3,833,054 | 9/1974 | Gross et al. | 176/67 |
| 4,030,541 | 6/1977 | Gross et al. | 165/175 |
| 4,709,757 | 12/1987 | Bly | 165/173 |
| 4,762,244 | 8/1988 | Ziegler | 220/203 |
| 4,763,724 | 8/1988 | Temmesfeld et al. | 165/71 |
| 4,947,931 | 8/1990 | Vitacco | 165/148 |
| 5,012,768 | 5/1991 | Roschinski | 123/41.49 |
| 5,107,924 | 4/1992 | Herbert et al. | 165/173 |

*Primary Examiner*—John K. Ford

*Attorney, Agent, or Firm*—Reising, Ethington, Barnard & Perry

[57] ABSTRACT

A fan shroud and receptacle arrangement for use adjacent a vehicle radiator and around one or more engine cooling fans. The arrangement includes a shaped hollow body of a predetermined depth and having a front face, a rear face, a top wall, a bottom wall, oppositely disposed side walls, at least one opening formed through the body with a cylindrical wall therearound. Oppositely disposed recesses are formed in the front and rear faces to form a wall for dividing the hollow body into two or more internal chambers. Filler necks and/or other openings are formed in the top wall for communicating with the two or more internal chambers.

7 Claims, 3 Drawing Sheets

FAN SHROUD AND RECEPTACLE ARRANGEMENT

FIELD OF THE DISCLOSURE

This invention relates generally to automotive radiator fan shrouds and, more particularly to such shrouds which are blow molded to include hollow compartments which serve as reservoirs for fluids, such as coolant fluid, and/or window and headlamp washer fluids, including air and other gasses.

BACKGROUND ART

Tangue et al U.S. Pat. No. 3,692,004 discloses a fan shroud and fluid receptacle arrangement including a cylindrical band or collar extending away from a radiator, and a radiator fluid receptacle and a windshield washer fluid receptacle integrally molded on opposite side surfaces of the cylindrical band or collar.

Two patents which disclose blow molded radiators are Gross et al U.S. Pat. Nos. 3,833,054 and 4,030,541.

Patents disclosing plastic radiators or associated parts thereof include Bly U.S. Pat. No. 4,709,757; Ziegler U.S. Pat. No. 4,762,244; Temmesfeld et al U.S. Pat. No. 4,763,724; Vitacco U.S. Pat. No. 4,947,931; and Herbert et al U.S. Pat. No. 5,107,924.

SUMMARY OF THE INVENTION

A general object of the invention is to provide an improved, compact and efficient blow molded radiator fan shrouds with integral fluid receptacles.

Another object of the invention is to provide a one-piece fan shroud arrangement wherein compartments, such as a radiator fluid overflow compartment, a windshield washer fluid compartment, and a headlamp washer fluid compartment, are integrally contained around side surfaces of at least one fan shroud formed as openings through a blow molded receptacle.

Another object of the invention is to provide a compact, one-piece fan shroud and dual fluid receptacle arrangement, resulting in: (1) the elimination of the need for space and fastening means for three separate components; (2) cost savings by virtue of having eliminated the need to manufacture three separate parts, while utilizing heretofore unused surrounding surface areas of the fan shroud; (3) the possible elimination of the need for retooling for different designs for specific vehicle models; (4) larger capacity windshield washer fluid and/or headlamp washer fluid compartments; (5) a radially and axially rigid structure; and (6) improved aerodynamic surface areas around the fan opening to allow higher, more efficient air flow through the fan shroud and receptacle assembly.

These and other objects and advantages of the invention will become apparent when reference is made to the following drawings and the accompanying description.

BEST MODE FOR CARRYING THE INVENTION

Figure 1:
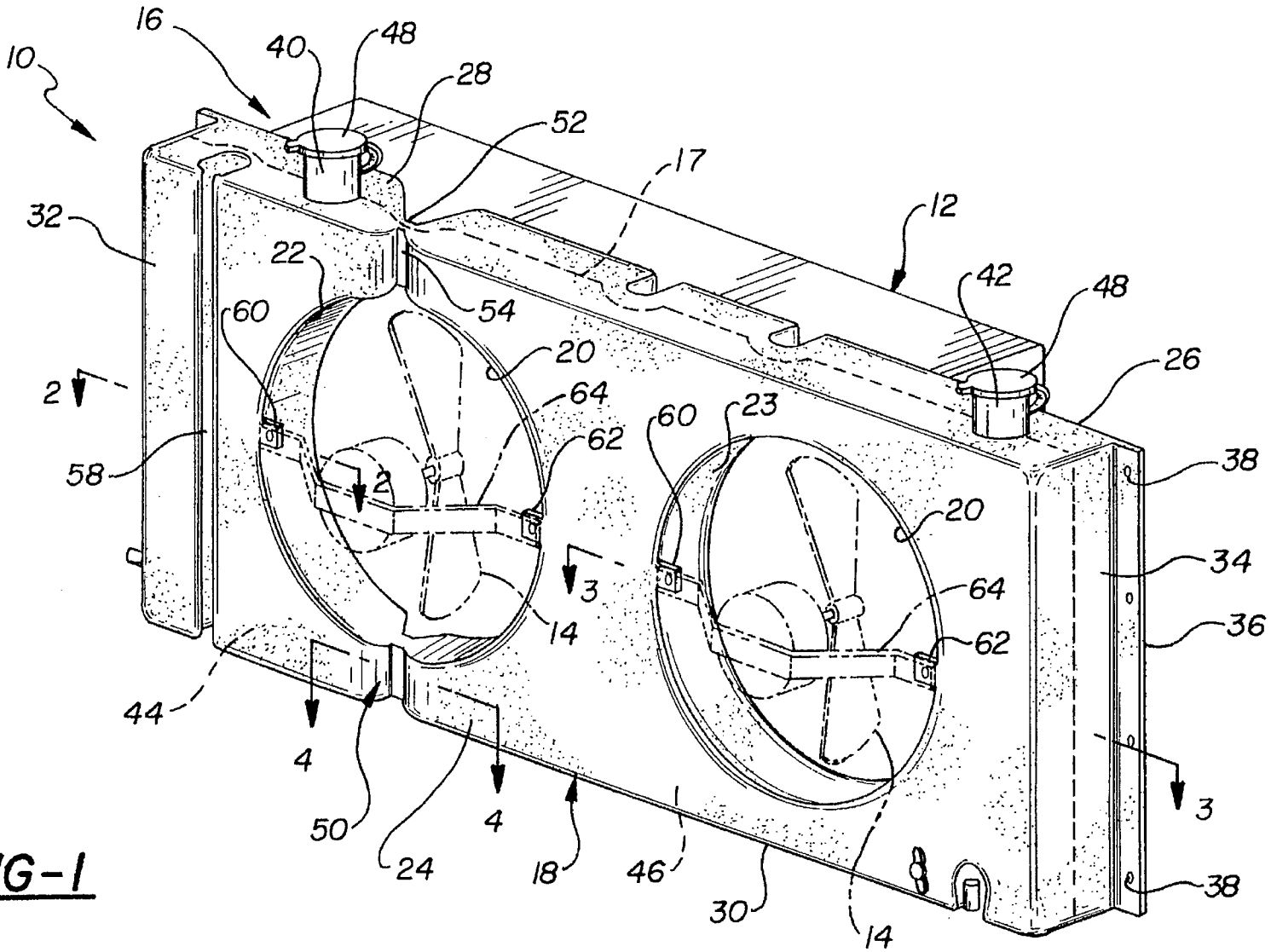
FIG. 1 illustrates a perspective view of a blow molded fan shroud embodying the invention.

Referring now to the drawings in greater detail, FIG. 1 illustrates an automotive engine cooling system 10, including a radiator 12, two engine cooling fans 14 shown in phantom, and a blow molded fan shroud arrangement 16. The latter arrangement 16 is blow molded (the mold parting line 17 is shown in phantom) to include a rectangular hollow body 18 of predetermined height, width and depth, and having dual openings 20 with respective cylindrical walls 22 and 23 formed therethrough and adapted to surround the outer peripheral paths of the two fans 14.

More specifically, the body 18 includes a front face 24, a rear face 26, a top wall 28, a bottom wall 30, and oppositely disposed side walls 32 and 34.

Figure 3:
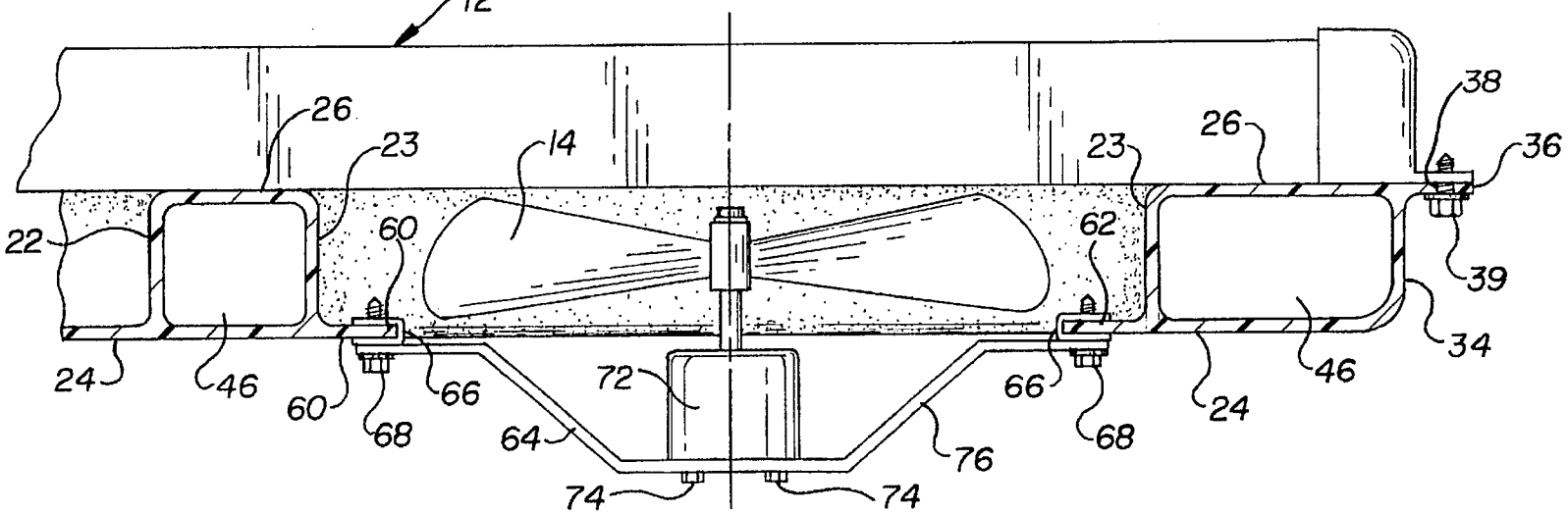

A flange or tab 36 is formed on an edge of each side wall 32 and 34. The flanges 36 include spaced mounting holes 38 adapted to accommodate fasteners 39 to mount the body 18 on the radiator 12 of the vehicle involved, as shown in FIG. 3.

A pair of filler necks 40 and 42 are formed at spaced-apart locations along the top wall 28, for communicating with respective chambers 44 and 46 formed within the hollow body 18, adjacent and around the cylindrical walls 22, as will be explained. A pair of removable caps 48 are mounted on the filler necks 40 and 42.

Oppositely disposed vertically oriented recesses 50 and 52 are formed in the respective front and rear faces 24 and 26 to provide walls 54 (FIG. 1) and 56 (FIG. 4) adjacent upper and lower portions of the cylindrical wall 22, serving to separate the chambers 44 and 46.

Additional recesses, such as the vertical recess 58 (FIGS. 1 and 2), may be formed in the front face 24 to accommodate wire harnesses, hoses, or the like.

Figure 2:
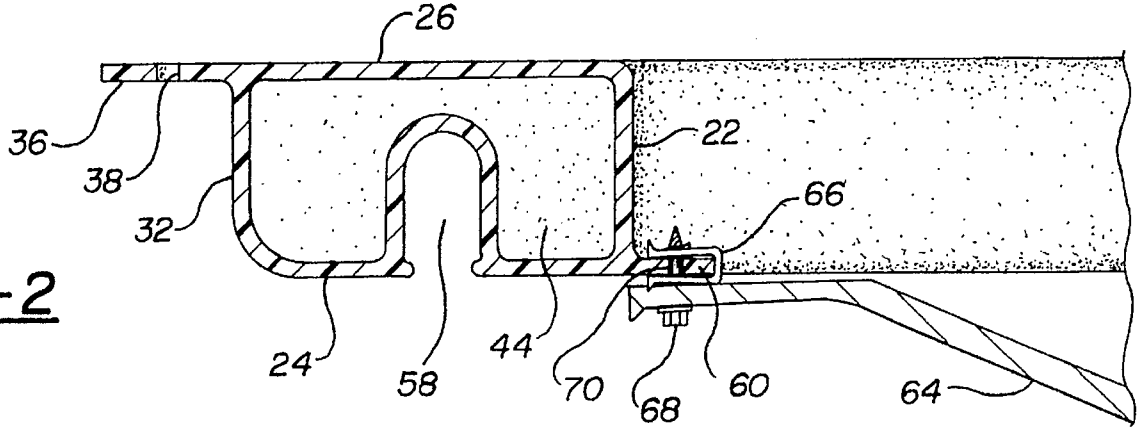
FIGS. 2, 3 and 4 are cross-sectional views taken along the planes of the lines 2—2, 3—3, and 4—4, respectively, of FIG. 1, and looking in the directions of the arrows.

Perforated tabs 60 and 62 are formed on opposite edges of each opening 20 to accommodate the mounting of fan assembly support brackets 64, as shown in FIGS. 2 and 3. A U-nut clip 66 is mounted around each tab 60 and 62, and a fastener 68 is mounted through aligned holes 70 formed in the clip 66 and each tab 60 and 62.

As shown in FIG. 3, a fan motor 72 is secured by suitable fasteners 74 to the inner surface of a U-shaped portion 76 of the support bracket 64.

The chamber 44 is enclosed by the front and rear faces 24 and 26, the top wall 28, the side wall 32, the bottom wall 30, the walls of the recesses 50 and 52 adjacent the lower recessed wall 56 (FIG. 4), the cylindrical wall 22 (FIG. 2), and the walls of the recesses 50 and 52 adjacent the upper recessed wall 54 (FIG. 1).

The chamber 46 encompasses a larger volume than the chamber 44, and is enclosed by the front and rear faces 24 and 26, top wall 28, the side wall 34, the bottom wall 30, the walls of the recesses 50 and 52 adjacent the lower separating recessed wall 56 (FIG. 4), the cylindrical wall 22, and the walls of the recesses 50 and 52 adjacent the upper separating recessed wall 54, while completely surrounding the cylindrical wall 23.

Figure 4:
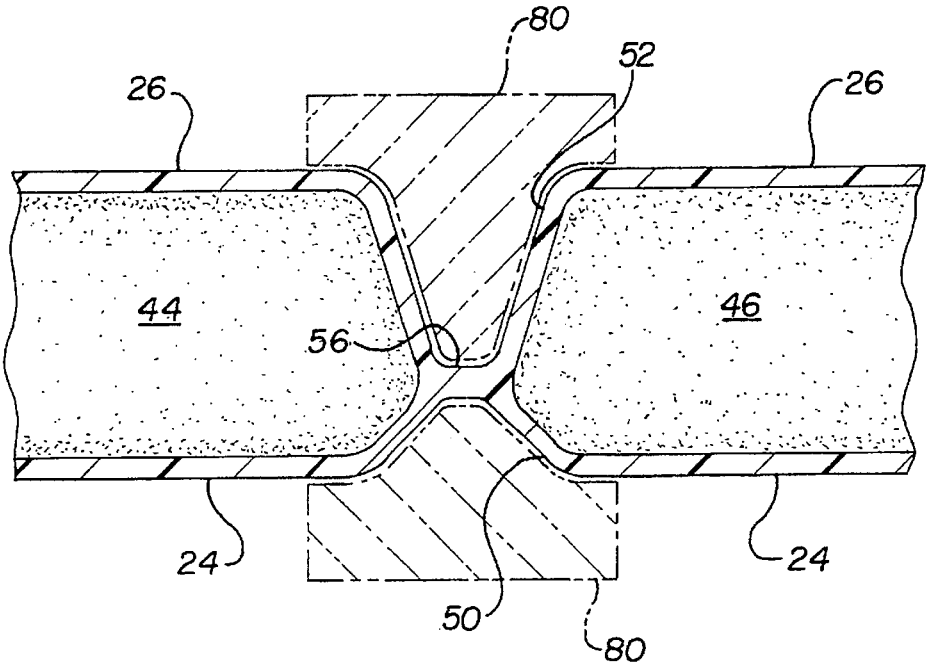

As represented in phantom in FIG. 4, the mold 80 design incorporates "tacks offs" to separate the chambers 44 and 46 in the molding process.

Figure 5:
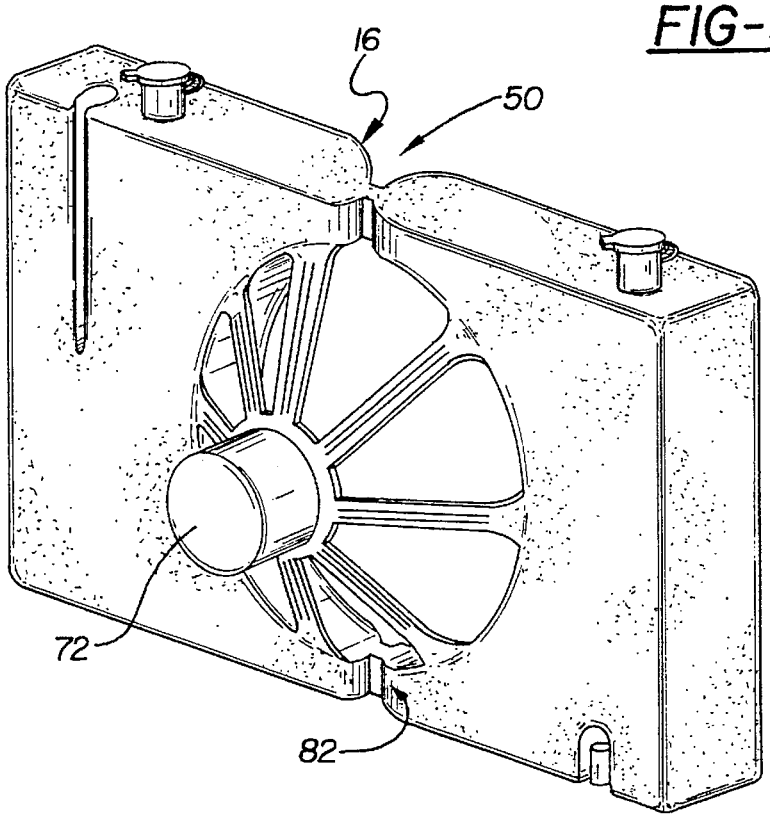
FIG. 5 is a perspective view of an alternate embodiment of the invention.

As shown in FIG. 5, in lieu of the separately attached fan assembly mounting bracket 64 shown in FIG. 3, an integral frame structure 82 may be compression molded during the blow molding process.

Industrial Applicability

It should be apparent that the invention provides a compact cooling system structure which eliminates the need for space and fastening means for three separate components in the already crowded engine compartment of today's automobile. It provides substantial cost savings by virtue of having eliminated the need to manufacture and assemble three separate parts, while utilizing heretofore unused surface areas of the fan shroud.

Additionally, the invention may provide a standard or uniform structure which is unaffected by many new vehicular designs. Specifically, the shape of the compartments 44 and 46 need not be redesigned each time the fender wells and other interior parts are changed on at least some new vehicle models. Also, the integrally molded windshield washer fluid or headlamp washer fluid compartments may have a larger capacity than the previously employed separate containers.

Furthermore, the resultant structure is extremely rigid, both radially and axially, and damped by fluid in the receptacles, reducing vibration or excitation of the fan shroud caused by the rotating fan surrounded thereby, hence diminishing a possible source of bothersome noise.

It should be further apparent that the inventive fan shroud and receptacle arrangement could be formed by one-piece gas assist injection molding, as well as by blow molding.

It should be still further apparent that, in lieu of the integral frame structure 82 of FIG. 5, and the separately attached fan assembly mounting bracket 64 and tabs 60 and 62 of FIG. 3, the openings 20 are adaptable to having fans mounted therein which are belt-driven and attached to the motor.

While but one embodiment of the invention has been shown and described, other modifications thereof are possible within the scope of the following claims.

What is claimed is:

1. A fan shroud and receptacle arrangement for use adjacent a vehicle radiator and around one or more engine cooling fans, the arrangement comprising a shaped hollow body of a predetermined depth and having a front face, a rear face spaced from said front face, a top wall, a bottom wall, oppositely disposed side walls, at least one opening formed through the body of a size to accommodate air flow through the vehicle radiator and having a cylindrical wall therearound, at least one set of oppositely disposed recesses formed in the front and rear faces to form a wall for dividing the hollow body into two or more internal chambers, and openings formed in the top wall for communicating with the two or more internal chambers.

2. The fan shroud and receptacle arrangement described in claim 1, wherein the wall for dividing the hollow body into two or more internal chambers is formed above and below the cylindrical wall.

3. The fan shroud and receptacle arrangement described in claim 2, including two openings having cylindrical walls therearound.

4. The fan shroud and receptacle arrangement described in claim 3, wherein one chamber completely surrounds one cylindrical wall.

5. The fan shroud and receptacle arrangement described in claim 1, and mounting tabs integrally formed on oppositely disposed sides of said at least one opening adapted to receive a fan assembly mounting bracket.

6. The fan shroud and receptacle arrangement described in claim 1, wherein the hollow body is formed by blow molding.

7. The fan shroud and receptacle arrangement described in claim 6, and a frame structure adapted to support a fan motor and integrally formed on the hollow body during the blow molding.

* * * * *